United States Patent [19]

Richard

[11] 4,056,259

[45] Nov. 1, 1977

[54] PROCESS AND APPARATUS FOR THE CONTINUOUS PREPARATION OF A MIXTURE FOR FOUNDRY MOLDS OR THE LIKE, WITH FORMATION OF A PREMIX

[75] Inventor: Gerard Y. Richard, Precy sur Oise, France

[73] Assignee: Societe d'Applications de Procedes Industriels et Chimiques S.A.P.I.C., France

[21] Appl. No.: 662,806

[22] Filed: Mar. 1, 1976

[30] Foreign Application Priority Data

Mar. 3, 1975 France ..... 75.06564

[51] Int. Cl.[2] ..... B01F 7/16; B01F 15/00; B01F 15/02

[52] U.S. Cl. ..... 366/15; 366/38; 366/65

[58] Field of Search ..... 259/8–10, 259/43–46, 165, 182, 185, 191–193; 425/200, 208

[56] References Cited

U.S. PATENT DOCUMENTS

| | | | |
|---|---|---|---|
| 2,487,533 | 11/1949 | Eastman | 259/9 |
| 3,430,929 | 3/1969 | Kawecki | 259/146 |
| 3,682,448 | 8/1972 | Kedzior et al. | 259/148 |
| 3,822,737 | 7/1974 | Edwards | 164/158 |

*Primary Examiner*—Leonard D. Christian
*Attorney, Agent, or Firm*—Keil, Thompson & Shurtleff

[57] ABSTRACT

Apparatus useful for the malaxation of a charge such as foundry sand, a refractory or abrasive particulate-like solid, powdered marble, gravel or like building materials embodying two mixing zones to first form a pre-mix of the charge and a constituent of a binder-hardener system and then form an intimate and homogeneous mixture of the pre-mix and the other constituent of the system within a few seconds followed by immediate evacuation or emptying of the resultant mixture. At least the second mixing zone is a mixing vessel with a cylindrical or conically tapered inner wall inside of which is rotated a drive shaft with radial arms, each bearing a hammer on its outer end, the hammers orbiting in the vessel with a clearance of only a few millimeters with the inner wall to attain thin film malaxation.

12 Claims, 4 Drawing Figures

PROCESS AND APPARATUS FOR THE CONTINUOUS PREPARATION OF A MIXTURE FOR FOUNDRY MOLDS OR THE LIKE, WITH FORMATION OF A PREMIX

The present invention relates to a method and an installation for the continuous preparation of a mixture comprising a granular and/or pulverulent charge agglomerated by a binder-hardener system.

This invention is especially applicable to the continuous preparation of a mixture from an inert charge such as a foundry sand for obtaining molds or cores, a refractory or abrasive product, powdered marble, a gravel or any other construction material, where the charge is in the form of more or less fine grains, e.g., lumps of a few millimeters or some tens of millimeters, agglomerated with the aid of a mineral or organic binder.

It is known that, particularly in the field of metal casting, for the purpose of forming molds or mold cores, it becomes necessary to produce mixtures of molding material which consist of grains or lumps of an inert charge (sand) agglomerated by a binder which imparts its plasticity to the sand, that is to say which enables the sand to acquire a shape under pressure and to retain it. A hardening agent which ensures the setting of this binder is also added.

These sand-binder-hardener mixtures generally self-harden as the temperature is raised; in certain cases they are even self-hardening at ambient temperature when an acidic hardening product is associated with a furanic resin, a urea-formol resin, or a phenol-formol resin.

At the present time several processes for the preparation of such self-hardening or self-curing mixtures are in use.

In the first place there are known installations which comprise two malaxators of conventional continuous kind with slow screws and arranged in cascade or series manner. The hardening agent is introduced into the center of the first malaxator in order there to form, with the charge, a pre-mix which is then conveyed to the second malaxator into which an orifice opens for the introduction of the binder. The final pre-mix-binder mixture is produced within this second malaxator. Since the two malaxators employed are devices inside which the mixed products move very slowly, a partial polymerization of the binder frequently takes place at the end of the second malaxator because the time of contact between the hardener and the binder is sufficiently long for such setting to begin.

When there has not been enough time for all the mixed mass to pass through the entire length of the screw of the second malaxator before it partially hardens, for one thing it is obvious that this situation results in a sand or poor quality and the mechanical properties of which will be reduced by about 20 percent. For the other thing there above all exists a definite risk of the malaxator breaking down unless it is immediately emptied.

Other known installations comprise a conventional malaxator having a slow screw followed by a metering screw which is in turn followed by a mixer having a frustoconical vat and a vertical shaft. The vertical shaft of the vat carries paddles which work by stirring the mass to be mixed and are driven to rotate more rapidly than the screw of the first malaxator. In the first malaxator there is produced a partial mixture of sand and of one of the two constituents of the binder-hardener system, the two aforesaid constituents being introduced by metering. Subsequently this partial mixture which has been metered by the intermediate screw is introduced into the vertical shaft final vat mixer at the same time as the second constituent of the binder-hardener system, likewise introduced in measured quantities. The final mixture is obtained by stirring the mass within the sealed vessel formed by the terminal frustoconical vat. When the mixture is homogeneous the discharge valve of this last vat is opened and the homogeneous mixture is immediately conveyed to the casting site.

French Patent Specification No. 2,033,644 describes an installation of this latter type. It is clear that by virtue of its very construction this installation has two serious disadvantages; firstly, this installation works discontinuously, and secondly, during each of its operating cycles it can only process a volume of homogeneous mixture which is limited by the internal useful capacity of the frustoconical final vat mixer.

Thus the field of application of this latter installation is restricted to producing mixtures of small or medium volume, of the order of 10 liters. It is clear that such an installation is extremely difficult to operate when it is required to form a mould of over 10 liters. For example, in order to produce a mould of 3 $m^3$, which is very often the case in metal casting, 300 successive batch-wise operations have to be performed so as to multiply by 300 the useful capacity of the final mixer and to obtain the filling of a mould whose volume is 300 times greater than that of the final mixer.

Moreover, it has been made clear that such an installation operates discontinuously. When the three constituents of the sand-binder-hardener mixture to be obtained have been successively introduced, after having been individually metered so as to fill the interior of the final mixer, the metering devices of the three constituents of the mixture no longer feed during the final stirring inside the frustoconical vat. Conversely, after emptying of the final vat, and during all the time required for filling this vat by supply from the metering devices of the three constituents of the mixture, the vertical final malaxator rotor is idling and does not operate.

In order to remedy the defects of the two above mentioned installations it has been proposed to produce mixtures by placing at the final stage of the installations a so-called "rapid" malaxator which, after a certain inertia interval, can operate continuously by stirring the mass to be mixed. Such a rapid malaxator comprises a malaxating vat within which a central shaft carrying blades rotates, at a faster speed than in the installation of French Patent Specification No. 2,033,644. The rotation of the blades in the mass to be mixed takes place along a horizontal axis inside a horizontal cylindrical barrel which causes the rapid malaxator appearance to resemble a conventional continuous malaxator having a vertical shaft within a vertical cylindrical-conical vat of vertical axis.

All these rapid malaxators, whether they be of the horizontal or vertical axis kind, provide in various degrees three advantages which are of interest in foundries. Firstly they reduce accidents. Next, they ensure an appreciable reduction or almost elimination of losses of sand. Finally, they enable moulds or moulding cores having setting times of a few seconds to be obtained, and this had been impossible with the installations which only comprised conventional continuous malaxators having slow screws and with the discontinuity operating installations of the kind described in French Patent Specification No. 2,033,644.

Hitherto the use of a rapid malaxator has resulted in two different techniques:

Some known installations consist of two conventional continuous malaxators having slow screws which are disposed in parallel and each open into a rapid malaxator of the vertical axis type. One of the slow screw malaxators continuously prepares a pre-mix of sand and binder and the other prepares a mix of sand and hardener. At the outlet of the slow malaxators these two separately prepared homogeneous pre-mixes are conveyed to and brought in contact within the rapid malaxator where the final mixture is then formed. At the present time the installations of the above mentioned kind enable the final mixture to be prepared either discontinuously as in the apparatus known as "Fascold" (BAKER-PERKINS LIMITED), or continuously as in the "Pacemaster" device (of FORDATH LIMITED). However, these installations share the same drawback in that the two separately formed premixes constitute two masses which are too great to be mixed intimately in an equally short time within the final vertical rapid malaxator. In other words, the final result is a heterogeneous mixture of two homogeneous pre-mixes.

Other known installations comprise in their final stage part a rapid malaxator of horizontal or vertical axis which enables the simultaneous incorporation of the hardener and the binder opposite the zone of entry of the charge. Thus there is no formation of a pre-mix, the final mixture of sand + binder + hardener taking place in the course of a single stage over all the length of the rapid malaxator. Among the numerous presently known installations of this type are: applicants own "Quick-set" apparatus, the apparatus known as "Sand-Turb" (STRONG-SCOTT) which is a rapid malaxator of horizontal axis, and the "Celecta-Flo" and "Centri-Flo" devices of CE-CAST, the first of which is a horizontal axia malaxator and the second a vertical axis malaxator.

However, all these installations share the disadvantage that since the hardener is introduced at the same time as the binder it reacts on the binder even before it is intimately mixed with the sand; consequently, in several zones, or whenever the hardener has locally and violently reacted on the binder, a major portion of the introduced binder has been destroyed. In such installations it is, therefore, necessary to provide an excess of binder. Now, this binder, which is most frequently a resin, is a material which is becoming both increasingly costly and of progressively decreasing availability. Clearly, there is a need to eliminate this excessive consumption of binder.

The present invention has as its purpose to eliminate all of the afore-mentioned drawbacks and, to that end, it intends to supply a process and an installation making possible the continuous preparation of a mixture which, in the first place, contains no polymerized fraction at the time of its distribution, in second place is unlimited with respect to volume quantity, and third place, is perfectly homogeneous, in fourth place, makes possible an appreciable reduction of binder consumption and in practice even insures an optimum binder consumption, and in fifth place, mixes only a very small quantity of charge at one time, thus completely eliminating the installation inertia at each one of its stops.

According to one aspect of the present invention we provide a method of continuously preparing a mixture of materials comprising a granular and/or pulverulent charge which is agglomerated by a binder-hardener system, characterized by: forming an intimate and homogeneous pre-mix by malaxating the charge and only one of the two constituents of the binder-hardener system; then introducing into a thin film malaxating apparatus the second constituent of the binder-hardener system so as to bring this second constituent into contact with the pre-mix, malaxating the final mixture of the pre-mix and the second constituent in the form of a thin film for a few seconds, and finally discharging the final mixture immediately to its point of use.

In a first embodiment of this method the pre-mix of the charge and the first constituent of the binder-hardener system is formed in a conventional, slow screw, continuous malaxator and is then conveyed to the thin film malaxating apparatus where the second constituent of the binder-hardener system is introduced so as to admix it to the pre-mmix to obtain the final mixture.

In a second embodiment of the method of this aspect of the invention the pre-mix of the charge and the first constituent of the binder-hardener system is formed within a first thin film malaxating apparatus, and is then conveyed to a second thin film malaxating apparatus, and the other constituent of the binder-hardener system is then introduced into this second thin film malaxating apparatus so as to admix it to the pre-mix to obtain the final mixture.

In a third embodiment of the method the pre-mix of the charge and the first constituent of the binder-hardener system is formed within a thin film single malaxating apparatus, and is then given the second constituent of the binder-hardener system; the first constituent being added to the charge substantially at the inlet of the said thin film malaxating apparatus where the charge is introduced; and the second constituent being added to this pre-mix substantially half-way between the zone of addition of the first constituent and the outlet of the said thin film malaxating apparatus.

In all the above disclosed embodiments of the method the binder is in contact with the hardener for only 1 to 3 seconds, at the time of formation of the final mixture by malaxating the pre-mix with the second constituent of the binder-hardener system within the or the last thin film malaxating apparatus. Since the final mixture is then immediately continuously discharged to its point of use the contact time of one to three seconds between the binder and the hardener is far too short for polymerisation of the binder to occur.

Moreover, the method of the invention facilitates a continuous working. When the respective quantities of inert charge, binder and hardener have been determined as a function of the final mixture to be obtained it is sufficient to feed continuously precise doses of these three constituents (for example, pre-mix of the charge and the hardener on the one hand and binder on the other hand) to the thin film malaxator, which implies that this malaxator of the installation operates continuously. It is also found that, since the three constituents of the mixture to be obtained feed the installation in precisely metered quantities the volume of the final mixture which is delivered by this final malaxator every second is perfectly known. As a result, the volumetric quantity of a mixture in well defined proportions, for example for filling a mould or a foundry core, is not limited. It is sufficient to allow the installation to work during a specific period of time so as to obtain at the outlet of the final malaxator a continuously delivered homogeneous mixture of a precisely known volume and adapted to fill the capacity of a mould or a core of which the useful volume to be filled will have made it possible to define by a simple calculation the duration of the operating stage of the said installation.

Thus the method according to the present invention has two important advantages over the method described in French Patent Specification No. 2,033,644. It will, moreover, be recollected that the final mixer recommended by the technique described in this patent is a mixer which works by agitating the mass. At certain times this malaxator rotates in neutral or idle phases, and at other times it is being supplied with pre-metered constituents. When all the constituents have been introduced into the final malaxator it is no longer possible to adjust the quality of the mixture of moulding material to be distributed.

On the other hand the method according to the present invention makes possible a direct adaptation according to the final mixture to be obtained. In fact, it is known that the quantity contained in the terminal malaxator of the installation at any moment is minute, since the mixture being worked travels within the malaxator in the form of a thin film disposed at the periphery of the vat. As a result, inertia of the malaxator is entirely eliminated, due to the principle of thin film working, and any modification of the proportion of one of the constituents is immediately translated into a modification of the homogeneous mixture delivered by the malaxator. Consequently, after delivery of a mixture in accordance with well-defined proportions of inert charge, binder and hardener it is always possible to modify simply the dose of at least one of the three constituents so as to produce a different homogeneous mixture intended for filling a further mould or core. This operation is also effected continuously. It is, for example, customary to commence the filling of a mould with a mixture rich in binder and to terminate the filling with a mixture low in binder. The method of the invention enables such an operation to be performed without it being necessary to arrest the rotation of the malaxator. When the mixture rich in binder has been introduced in sufficient quantity into the mould, the amount of binder and of hardener to be introduced are simultaneously reduced and consequently one obtains immediately at the outlet of the thin film malaxator a mixture which is poor and will complete the filling of the mould.

It is also found that, since the masses of on the one hand the pre-mix and of, on the other hand, the second constituent of the binder-hardener system which have to be intimately mixed in a very brief time within the thin film malaxator are themselves minute, mixing them presents no difficulty and consequently the final mixture obtained is itself homogeneous.

Finally, it should be made clear that in the preferred form of the method according to the invention the preliminary mixing is of the inert charge and the hardener. As a result, the pre-mix of charge and hardener is homogeneous, that is to say that in no zone of this pre-mix is there present a quantity of hardener which is excessive and capable of reacting on, and to destroy violently, the binder which is subsequently admixed in thin layer. The method according to the invention thus restricts the use of binder in a disproportionate amount since all of these constituent is used at the end of agglomeration with the inert charge.

From the three above described embodiments of the method it is evident that the third embodiment will be the one which is preferred since it limits the installation to a single thin film malaxator. The use of a single malaxator naturally leads to a more compact installation as well as a cheaper one.

The method of the invention is applicable to the continuous preparation of any mixtures of materials to be molded; thus the fields of use of the method are manifold for example: foundries, the refractory industry, building, finishing and polishing shaped articles. The charges which could be mixed include as a few examples only: sand, refractory, ceramic or abrasive materials such as aluminous charges chromite, olivine, or powdered marble, a gravel, and generally any building material.

The present invention also has as its object the new industrial product represented by an installation for the execution of the above process, characterized by the fact that it comprises in its essential part a thin film malaxating apparatus, said apparatus comprising: a. means for the introduction and/or the formation by malaxating of the pre-mixture composed of charge and of one only of the two constituents of the binder-hardener system, b. means for the introduction, in a separate manner, of the second constituent of the binder-hardener system, c. means for the admixing of that second constituent to the pre-mix, and d. means for the immediate evacuation of that final mixture obtained after intimate and homogeneous malaxating for a few seconds, of said second constituents with the pre-mix.

In a first embodiment of the device the thin film malaxating apparatus includes means for the introduction thereto of the pre-mix of charge and of the first constituent of the binder-hardener system; wherein the means for forming the pre-mix by malaxating comprises a slow screw malaxator upstream of the said thin film malaxating apparatus and arranged to delivery the pre-mix to said pre-mix introduction means to be mixed with the second constituent of the binder-hardener system in the thin film malaxator so as to produce the final mixture.

In a second embodiment the thin film malaxating apparatus comprises means for the introduction of the pre-mix of charge and of the first constituent of the binder-hardener system; and wherein upstream of said thin film malaxator is a first stage malaxating apparatus, also of the thin film type for producing the pre-mix; and wherein means are provided for conveying the pre-mix from the first stage thin film malaxator to the downstream thin film malaxating apparatus.

In a third embodiment the thin film malaxating apparatus is adapted also to form the pre-mix by malaxating of the charge and of the first constituent of the binder-hardener system and comprises an inlet for the charge, an outlet for the final mixture obtained within said apparatus, a first inlet orifice for the first constituent of the binder-hardener system preferably located near the inlet of apparatus, and a further inlet orifice, spaced from the first orifice, for the second constituent of the binder-hardener system preferably located half-way between the first orifice and the outlet of said apparatus.

In this third embodiment the first mentioned inlet orifice for the first constituent is spaced from said further inlet orifice for the second constituent by a distance such that the homogeneity of the pre-mix obtained by malaxating the charge and the first constituent substantially equals that which is necessary for the formation of the final mixture in the time elapsing between the instant when the second constituent is added to the pre-mix in the thin film malaxating apparatus, and the instant when the final mixture is discharged therefrom.

In all the above described embodiments of the installation, whether they comprise a first, slow or thin film malaxator, followed by a thin film malaxator, or whether they consist exclusively of a single thin film malaxator, there is produced in a first stage a homogeneous mixture of sand and of only one of the two constituents of the binder-hardener system, and then in a second stage the final mixture by adding to the said pre-mix, during a very brief time of a few seconds only, the second constituent of the binder-hardener system.

As a general rule, and for reasons which will later be expounded, the pre-mix will be produced by malaxating the sand and the hardener, and consequently it is the binder which will be added last, so as to form the final mixture within the malaxator operating by thin layer. Since the hardener is mixed with the charge of sand so as to form a homogeneous pre-mix, it is clear that the above mentioned disadvantages, which consisted in throwing the hardener and the binder on the sand simultaneously are avoided. This prior method had caused local and violent reactions of the active product which is the hardener on the passive product which is the binder, and hence destruction of a certain amount of binder, so there was the necessity of introducing an excess of binder into the installation so that the agglomeration of the charge should be correct.

In the installations of the invention the binder is added at the last moment, and very quickly, to the pre-mix with which it mixes intimately so as to provide the final mixture without any destruction of resin occurring. The performance data which will later be given by way of comparison make it possible to establish that the consumption of resin utilised when the installations according to the invention are employed can in practice be reduced to its optimum quantity.

In a particularly advantageous embodiment the thin film malaxating apparatus which constitutes the installation or forms the terminal part of said installation comprises an external vessel; a central shaft which is homothetic with the internal shape of the vessel and is of large diameter relative to the internal capacity of said vat so as to leave only a narrow annular space around the shaft; means for rotating the said shaft at very high speed; the hammers carried by said shaft for passing close to and along the internal surface of the vessel to contact the mass to be mixed only by their extreme edges so as to assist the thin film working and to limit to the greatest extent the volume of the mass being treated in the malaxator vessel.

Since the central shaft occupies a very large volume interiorly of the malaxator vessel and furthermore this shaft rotates at a very high speed, turbulence and air currents will be formed which naturally advance the materials to be mixed towards the periphery of the vessel. It is thus apparent that by this construction the formation of a thin film is favoured, that is to say of a kind of film all over the internal surface of the malaxator vessel. The turbulence, on the one hand, and the repeated contact of the extreme edges of the malaxator hammers on the mass to be mixed, on the other hand, cause a very intensive malaxating action on the materials to be mixed, while leaving the latter in the form of a simple layer which uniformly covers the internal wall of the malaxator vessel.

In such an embodiment the hammers are inclined so as to form a screw thread or helix suitable for conveying the mass of material being worked in thin film form from the inlet to the outlet of the malaxator vessel. Consequently the rotation of the central shaft causes the mixed mass to advance gradually, and at a uniform rate, from the inlet towards the outlet of the malaxator, by simple contact of the extreme edge of the hammers on the mass to be mixed.

In a preferred embodiment the hammers are disposed in overlapping relationship all along the central shaft in such manner as to sweep all the internal surface of the vessel during rotation of said shaft. There is thus no annular zone of the vessel which is not worked by the hammers. Since the scraping of the worked mass is regularly effected by the hammers over all the length of the malaxator vessel, there is no point where the mass could stagnate and harden with the risk in the long term of jamming the operation of the thin film malaxator.

The central shaft is either a cylinder of large diameter in the case of a horizontal cylindrical vessel or a frustum of a cone in the case of a vertical frustoconical vessel when the conicity of shaft and vessel will be equal. Consequently, the narrow annular space remaining along the malaxator vessel for the mass to be mixed is of substantially constant radial thickness. Since the scraping action of the hammers takes place in a regular manner over all the length of the vessel it follows that the mixture formed within this vessel and delivered at the outlet of the thin film malaxator is necessarily homogeneous.

In order that the present invention should be better understood there will now be described, by way of illustrative and not limitative examples, various embodiments of an installation according to the invention, with reference to the accompanying drawings in which.

Throughout the following description with the object of simplifying the wording and improving the understanding of the invention, the hardener in the examples of mixing will be taken as the "first constituent" of the binder-hardener system, and the binder as the "second constituent" of the binder-hardener system. In all the examples mentioned the pre-mix is thus obtained by malaxating sand and the hardener, and the final mixture is obtained by malaxating the pre-mix and the binder.

Referring to the Figures it will be seen that the thin film malaxator is designated 11 when it is of horizontal axis and 21 when it is of vertical axis. This thin film apparatus is either arranged as the final stage of the installation of the invention (as in FIGS. 1 to 3) or itself forms this installation (as shown in FIG. 4).

In all the proposed embodiments the malaxator 11 or 21 comprises an orifice 12 for introduction of the binder for addition to the pre-mix, and an outlet 13 for the immediate discharge of the final mixture obtained after intimate and homogeneous malaxating of the binder and the pre-mix.

Figure 1:
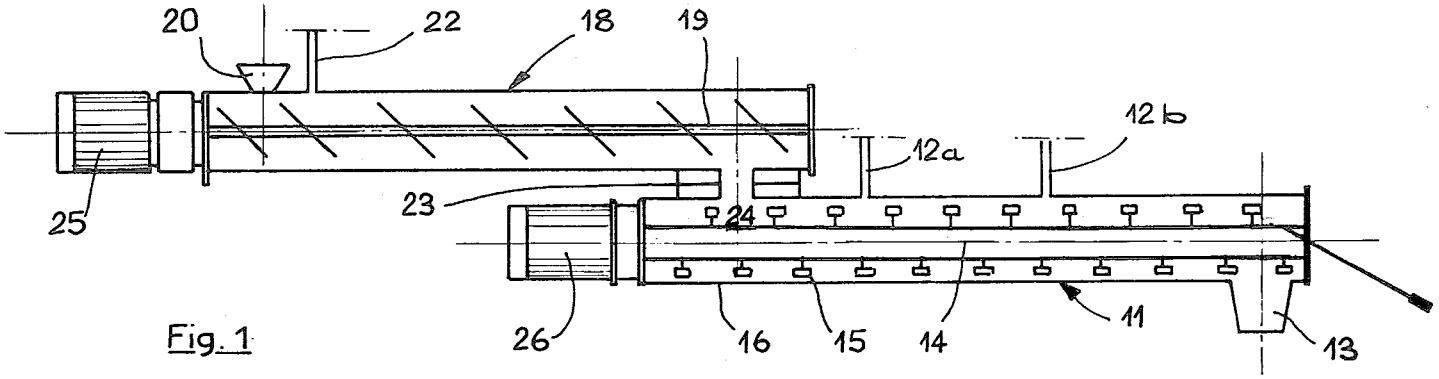
FIG. 1 shows a first embodiment of an installation comprising a conventional continuous malaxator having a slowly rotating screw, followed by a "thin film" type malaxator of horizontal axis.
Figure 4:
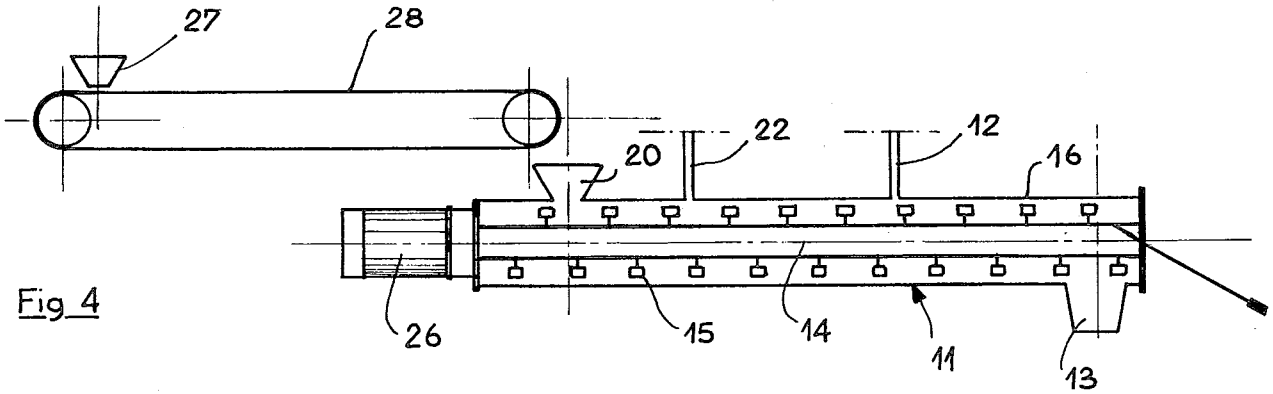
FIG. 4 shows a fourth embodiment of installation comprising a single thin film malaxator having a horizontal axis, within which the pre-mix of sand and hardener is formed in the upstream half and the final mixing of pre-mix and binder takes place in the downstream half.
Figure 2:
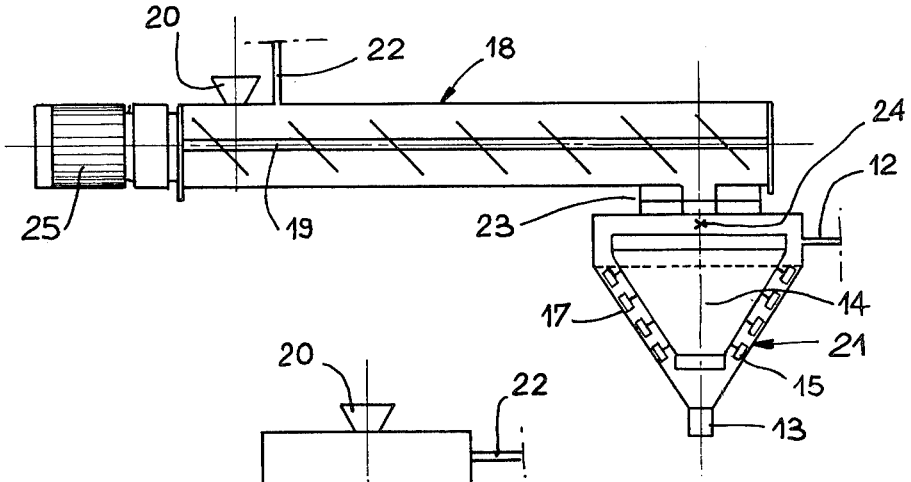
FIG. 2 shows a second embodiment of an installation comprising a conventional continuous malaxator with slowly rotating screw, followed by a vertical axis, thin film type, of frusto-conical malaxator.
Figure 3:
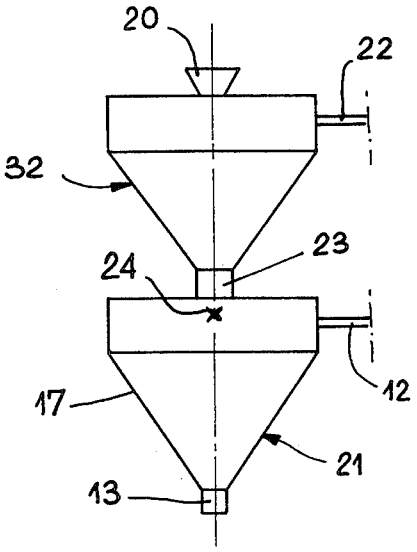
FIG. 3 shows a third embodiment of the installation comprising two thin film malaxators disposed in cascade fashion.

The rotor for adding and admixing the binder to the pre-mix comprises a rapidly rotating central shaft 14 carrying hammers 15 which come very close and along the internal surface of the malaxating vessel which is either a horizontal cylinder 16 in the horizontal malaxator 11 of FIGS. 1 and 4, or a frustum 17 of a vertical cone in the case of the vertical malaxator 21 of FIGS. 2 and 3.

In the case of the horizontal malaxator 11, the central shaft 14 is a cylinder co-axial with the vessel 16, so that the annular space formed between the shaft and the vessel is of constant radial thickness throughout the length of the malaxator 11.

In the case of the vertical malaxator the central shaft 14 is a frustum of a cone of identical conicity as and coaxial with the vessel 17, so that the annular space formed between the shaft and the vessel is also of constant radial thickness throughout the height of the malaxator 21.

In the two above mentioned examples the shaft 14 is large in size relative to the vessel, such that during its high speed rotation it generates forces which apply the material to be mixed against the internal surface of the vessel 16 or 17 in the form of a thin film. In the horizontal malaxator the central shaft is of a diameter substantially equal to half the diameter of the vessel 16. In the vertical malaxator the frustum of cone is, in each of its horizontal cross-sections, of a diameter which is never less than half the diameter of the vessel 17 taken in the same horizontal plane.

The hammers 15 carried by the shaft 14 are each connected to the shaft by an arm which is perpendicular to the shaft. In the horizontal malaxator 11 the arm passes radially through the shaft 14 and is threaded at its end remote from the hammer so that a nut screwed on said threaded end renders the hammer and the shaft integral. As a result of this thread, the radial position of the arm relative to the shaft is adjustable and in this manner, by tightening or slackening the nut, it is possible to arrange for the hammer to have its extreme edge as near as possible to the internal surface of the vessel 16. Only a few millimeters are left present between the extreme edge of the hammers and the vessel so as to assist the working of the thin film of material, and to limit to the greatest extent the volume of the mass which is at any time treated in the vessel of the malaxator.

The malaxator 11 or 21 comprises either means for the introduction of the pre-mix of charge and the hardener (FIGS. 1, 2 and 3) or means for the formation of said pre-mix by malaxating directly within said malaxator (FIG. 4).

The horizontal thin film malaxator 11 of FIG. 1 is preceded by a conventional continuous malaxator 18 having a slowly rotating screw 19. This slow malaxator 18 has an inlet 20 for the sand, an orifice 22 for incorporation of the hardener and an outlet 23 which enables the pre-mix obtained at the end of the screw 19 to be conveyed to the inlet 24 of the thin film malaxator 11. The inlet 20 is, of course, situated at the upstream portion of the screw 19 and the orifice 22 is disposed close to the inlet 20, so that the pre-mixing of the sand and the hardener should take place over the longest possible axial extent of the screw 19 and thus the pre-mix should consequently be dispensed into the malaxator 11 in a perfectly homogeneous condition.

The installation of FIG. 1 operates as follows: After start-up of the motor 25 driving the slow screw 19 and the motor 26 driving the shaft 14 carrying the hammers 15 in the thin film malaxator the sand is introduced via the inlet 20, and the hardener via the orifice 22, for example using a conventional method using a metering pump for the hardener and releasing a slide valve disposed below an anti-load cone in a sand filled hopper whereby the anti-load cone ensures a constant supply of the flow of sand. By malaxation along the screw 19, the intimate and homogeneous pre-mix is obtained in a time, which may vary between 15 and 90 seconds, which depends on the speed of rotation of the slow screw and is determined by the products to be mixed. The homogeneous pre-mix is then poured into the upstream portion of the horizontal thin film malaxator 11 and it is transported very rapidly, in a time of the order of 1 to 3 seconds, from this upstream portion 24 to the outlet 13 of the malaxator 11. Since the malaxator 11 utilises the centrifugal force of the rapidly rotating shaft 14 and hammers 15, the pre-mix is applied against the periphery of the vessel 16 in order to there be worked in a thin layer. An inclination of the hammers relative to the axis of the shaft 14 ensures the advance of the pre-mix along the vessel. The orifice for the incorporation of the binder into the interior of the malaxator 11 may be situated in the zone defined between the passages 12*a* and 12*b*, that is to say substantially between the upstream zone of the shaft 14 and the middle zone of said shaft. The binder which is applied against the wall of the vessel by the centrifugal force is added to the pre-mix which is advancing within the apparatus 11 and it is then in turn driven by the hammers 15 towards the exit 13. Since the malaxator 11 operates on a thin film principle the degree of homogeneity of the mixing of the pre-mix and the binder is substantially sufficient for the final mixture discharged via the outlet 13 to be likewise a perfectly homogeneous mixture.

The installation of FIG. 2 differs from that of FIG. 1 solely in the choice of the final malaxator. The sand flowing at 20 and the hardener metered at 22 are mixed during their movement along the slow screw 19, as in the preceding example, and are then poured at 23, in the form of a homogeneous pre-mix, onto the portion 24 of the frusto-conical vertical rotor of the malaxator 21. The pre-mix is then added to by the binder dispensed at 12 by a metering pump, and the final homogeneous mixture is obtained in 1 to 3 seconds of malaxating during the vertical downward movement of the mass consisting of the three constituents sand-hardener-binder. The final mixture is dispensed via the exit 13 under a quite high pressure in the form of a very homogeneous product.

In the installation of FIG. 3 the slow screw malaxator 18 of FIG. 2 has been replaced by a thin film malaxator 32 of the same type as malaxator 21, employed as the final state of the installation. In this installation the sand and the hardener, which are respectively introduced through the orifices 20 and 22, are mixed in the form of a thin film in the malaxator 32 so as to form a pre-mix which is homogeneous and which is conveyed via the outlet 23 to the inlet 24 of the final malaxator 21. The binder is fed to the inlet zone of this second thin film malaxator via the orifice 12 so that the binder is added to the pre-mix to form, within 1 to 3 seconds, the final homogeneous mixture inside the final malaxator 21. The final mixture is directly and continuously dispensed via the outlet 13.

In contrast to each of the final stage malaxators of the installations of FIGS. 1 to 3 into which the homogeneous pre-mix of the charge and the hardener is introduced so as to add the binder, the horizontal malaxator 11 of FIG. 4 enables the formation of the pre-mix and of the final mixture to be effected concurrently. Thus it forms the essential part of such an installation. The sand is introduced into the installation as a steady flow via the charging orifice 20 at the entry of the shaft 14. The sand may, for example, be previously poured from a hopper 27, provided with an anti-load cone and a slide valve, onto the upper run of a conveyor belt 28 which transports the charge to above the orifice 20. The hardener is introduced into the malaxator 11 via the orifice 22 situated directly downstream of the orifice 20, and the binder is introduced via the orifice 12 provided substantially half-way between the orifice 22 and the outlet 13 of the malaxator 11. In this manner there is produced, in a first stage of the malaxator, a pre-mix of sand and hardener and once this pre-mix is homogeneous, which is readily achieved over the upstream half of the length of the horizontal cylindrical shaft 14, the binder is added at 12 so as to produce in the downstream half of the malaxator 11 the final homogeneous mixture of the pre-mix and the binder. As a result of the equal spacings between, on the one hand, the hardener introduction orifice 22 and the binder introduction orifice 12 and, on the other hand, the orifice 12 and the outlet 13, the time of formation of the pre-mix, by malaxating the charge and the hardener, substantially equals the time of formation of the final mixture occurring between the instant when the binder is added at 12 to the pre-mix and the instant when the final mixture is discharged at 13.

With the aid of the following Table it is possible to compare the quantities of resin necessary for ensuring, as a function of a specific malaxation, the preparation of a mixture which conforms to certain specific mechanical characteristics. The mechanical characteristic presently maintained is the resistance to flexion, which is constant for a given binder, of 45 kg/cm². The binder is a furane resin or a phenolic resin marketed by Applicants under the names "FAREZ" and "PENAREZ" respectively.

| TYPE OF INSTALLATION | MALAXATING TIME | % OF RESIN FOR A FLEXION OF 45 kg/cm² |
|---|---|---|
| I Discontinuous malaxator | a) Pre-mix : 60 to 90 secs.<br>b) Final malaxating : 60 to 90 Secs. | 1.15% |
| II Installation of two slow malaxators disposed in parallel and followed by a "rapid" malaxator | a) Two pre-mixes of 15 to 20 secs. each<br>b) Final rapid mixing of the two pre-mixes : 5 to 15 secs. | 1.15% |
| III Installation of one "rapid" malaxator with simultaneous introduction of sand, hardener and binder | a) Pre-mix : none<br>b) Malaxating of all components : 3 to 20 secs. | 1.00% |
| IV Installation of two slow malaxators in cascade arrangement | a) Pre-mix : 15 to 20 secs.<br>b) Final malaxating : 15 to 20 secs. | 0.85% |
| V Continuous installation of the invention: pre-mix (slow or thin film) followed by a final thin film malaxating of the pre-mix and of the second constituent of the binder-hardener system | a) Pre-mix : 2 to 20 secs.<br>b) Final malaxating: 1 to 3 seconds | 0.65% |

This Table illustrates the important influence of the formation of a pre-mix, since the solutions of Examples IV and V both give a result clearly preferable to that of Example III. Secondly, it shows the important influence of the malaxating time once the binder and the pre-mix are brought together, that is to say the time during which the hardener can react on the binder, since the solution of Example V gives a result clearly superior to that of Example IV.

Moreover, it is known from experience that an inactive mixture of sand and binder disposed inside a mould provides the same mechanical characteristic of resistance to flexion of 45 kg/cm² when it is subsequently hardened by introduction, in the form of a gas or an aerosol, of an acidic hardening agent, such as sulfur dioxide, when the percentage of resinous binder is 0.60 percent. It is clear that this value of 0.60 percent is the minimum proportion of binder which needs to be added to the sand, since in such a case the time of contact between the binder and the hardener is zero. Consequently, it can be seen that the installation according to the present invention makes it possible in practice to arrive at this same optimal value since the formation of a pre-mix, in a slow or thin film manner, of sand and hardener, followed by a final thin film malaxation of the pre-mix and the binder requires only 0.05% more than the theoretical minimum value. The economy of the thus obtained product is quite appreciable.

The installation of FIG. 4 is, of course, by far the most interesting one since it is the most compact apparatus and can be readily constructed to the following specifications:

1. A horizontal vessel 16 of 230 mm. internal diameter encloses a central shaft 14 of 112 mm. external diameter equipped with 32 hammers per meter arranged in four rows of eight. The hammers may be disposed in random manner but they are preferably offset so as to form four helices which lead the materials to be mixed from the entry to the exit of the malaxator 11. Each of the 32 hammers is inclined by 45° to the axis of the shaft. Its length, projected on said axis, is 4 cm. and it is consequently apparent that there is coverage of the hammers over all the length of the vessel implying that the entire internal surface of the vessel is swept so that the mass worked in the thin film is continually moving toward the exit 13. This prevents or reduces the incidence of prolonged stagnation of part of the mixture which could harden within the malaxator and damage the hammers 15.

Each arm carrying a hammer is mounted on the shaft 14 such that there is left a clearance of 5 mm. between the extreme edge of the hammer and the internal surface of the vessel 16. The circumferential speed must be at least 10 meters/sec. and it will preferably be between 12 and 15 meters/sec. this range corresponding to the optimal functioning of the installation. The overall length of the malaxator may vary between 1.2 and 3 meters. For a malaxator of 2 meters length the duct 22 is situated 0.65 meters from the outlet of the hopper 20, while the orifice 12 for introduction of the binder is situated 0.8 meters and 0.55 meters respectively from the orifice 22 and the exit 13. As a result of the high rate of rotation of the central shaft 14 and the hammers 15 the constituents binder and hardener are, when introduced into the vessel, thrown onto the internal surface of the vessel in the form of a mist which moves downstream and also upstream of the vessel. Moreover, as a general rule, the binder and hardener components will be introduced by pulverisation, in view of the brief time of mixing in the malaxator and in view of the immediate formation of the thin film. The turbulences caused by the shaft 14 which occupies a major space interiorly of the vessel 16 also participate in the pulverisation of the products which are instantaneously applied against the wall of the vessel.

The malaxator thus obtained has an output which can be varied between 0.5 and 5 kg/sec. This output is a function of the quantities of constituents introduced at 20, 22 and 12. The flow may, moreover, change instantaneously since this malaxator has virtually no inertia. In a horizontal vessel of 310 mm. internal diameter there is disposed a central shaft of 154 mm. external diameter carrying, as in the preceding Example, 32 hammers per meter disposed in four rows of eight so as to form four helices. All the hammers are inclined at 45° on the axis of the shaft and the four halices thus formed regularly advance the mixed mass from the entry toward the exit of the malaxator. The length projected by each hammer on the axis of the shaft is also 4 cm. i.e. a total of 1.28 meters for 32 hammers, which explains that there is effective coverage of the hammers over the entire length of the vessel. The hammers of Example 2 are moreover identical to those of Example 1, the only modification being that the effective length of the carrying arm is adjusted to a greater value so that the extreme edge of each hammer comes to 5 mm. from the internal surface of the horizontal vessel. The circumferential speed of the malaxator of this kind is also equal to a minimum of 10 meters/sec., and it is preferably from 12 to 15 meters/sec. The total length of the malaxator may vary between 1.5 and 3 meters. For a malaxator of 2 meters total length the respective positions of the orifices 12 and 22 and the hopper 20 will be the same as in the preceding Example. Under the above mentioned conditions the malaxator has an output which can be varied between 1.5 and 15 kg/sec. Of course, this output may also continually vary, without any inertia, since it is sufficient for the user to reduce or increase the supply of at least one of the three constituents so as to modify the flow of final mixture delivered.

The invention is, of course, not limited to the embodiments nor to the modes of application which have been described and a number of variations are conceivable within the scope of the following claims. This applies in particular to the installation of FIG. 3 comprising two vertical malaxators arranged in cascade manner. It is quite clear that any one or both vertical malaxators could be replaced, respectively, by one or two thin film horizontal axis malaxators such as schematically shown by 11 in the drawings.

Throughout the preceding description there has been preferably chosen a final mixture obtained by introducing the hardener as the first constituent of the binder-hardener system for mixing it with the sand as the second constituent, so that the binder is introduced at the last moment so as to be worked in, on the thin film principle, with the pre-mix to provide the final homogeneous mixture.

It is quite obvious that if the order of introduction of the binder and hardener components were to be inverted the efficacy of the method of malaxating in two stages would remain valid in its entirety, although the economy of the binder would then be less spectacular as a result of the pulverisation of the hardener on the charge + binder pre-mix; in fact such a pulverisation could lead to a partial destruction of the binder.

This second mode of applying the method according to the invention will thus be reserved for specifically such special cases in which the chemical nature of the charge makes it possible to envisage a reaction with the hardener at the pre-mix stage, as in the cases of ceramics, chromite, olivine, aluminous charges in general with an acidic hardener for example. In this event an installation comprising exclusively thin film malaxators will advantageously be used, to the exclusion of slow screw malaxators, for the formation of the binder and charge pre-mix. Installations for this kind of use will thus be comprised of two horizontal or vertical malaxators 11 or 21, or again a single thin film malaxator as shown in FIG. 4.

What we claim is:

1. Apparatus useful for the malaxation of a charge and one constituent of the two constituents of a binder-hardener system to form a pre-mix followed by admixture of said pre-mix with the other constituent of said two constituents of said binder-hardener system, which apparatus comprises first malaxation means for forming a homogeneous pre-mix of said charge and said one constituent, second malaxation means embodying agitator means operable to obtain intimate and homogeneous admixture of said pre-mix and said other constituent within a few seconds followed by immediate evacuation of the resultant mixture from said second means, at least said second means being characterized by a mixing vessel having a cylindrical or conically tapered inner wall, a drive shaft extending coaxially in said vessel, a plurality of arms extending radially from said shaft, and a hammer on the radially outer end of each arm, said hammers respectively having a clearance with said inner wall, as they orbit upon rotation of said shaft, of only a few millimeters to provide thin film malaxation of the constituents of said resultant mixture.

2. Apparatus as claimed in claim 1 wherein said vessel has a cylindrical inner wall, and the diameter of said shaft being substantially equal to half the diameter of said cylindrical inner wall.

3. Apparatus as claimed in claim 1 wherein said vessel has a vertical axis and a downwardly conically tapered inner wall, and said drive shaft rotates about said vertical axis and has a downward taper with diameters at respective horizontal cross sections through said vessel and said shaft wherein the diameters of the shaft are never less than half the diameters of said inner wall in the respective horizontal cross sections.

4. Apparatus as claimed in claim 1 wherein said vessel has a cylindrical inner wall of horizontal orientation.

5. Apparatus as claimed in claim 1 wherein said first means comprises a vessel with a slowly rotating mixing screw.

6. Apparatus as claimed in claim 1 wherein said first means is a vessel as characterized in claim 1 for said second means, both vessels being separate vessels and means to feed said pre-mix from said first means to said second means.

7. Apparatus as claimed in claim 1 wherein said first means and said second means are part of a common vessel with inlet means for said charge at the upstream end of said common vessel, outlet means for said resultant mixture at the downstream end of said vessel, second inlet means near the upstream end of said vessel for said one constituent, and third inlet means for said other constituent positioned downstream of said second inlet means and upstream of said outlet means.

8. Apparatus as claimed in claim 7 wherein inlet means for said one constituent is remote from inlet means for said other constituent in a manner such that the homogeneity of the pre-mix obtained through malaxing of the charge and of said one constituent is approximately equal to that necessary for the formation of the resultant mixture, defined between the time when said second constituent is added to the pre-mix in said second means and the time when the final mixture is evacuated from said apparatus.

9. Apparatus as claimed in claim 1 wherein said hammers are inclined so as to form a screw thread or helix for conducting the mass of material being worked in thin film form from the entry end towards the discharge end of said vessel.

10. Apparatus as claimed in claim 1 wherein the hammers are arranged in overlapping fashion along the shaft so as to sweep all the internal surface of the inner wall when said shaft rotates.

11. Apparatus as claimed in claim 1 wherein said inner wall is cylindrical and said drive shaft is a coaxial cylinder of large diameter providing a small annular clearance between said inner wall and said drive shaft.

12. Apparatus as claimed in claim 1 wherein said inner wall is frusto-conical, and said drive shaft is coaxially frusto-conical and of a size and taper providing a substantially constant, small annular clearance between them.

* * * * *